United States Patent [19]

Wehrli

[11] 3,940,158

[45] Feb. 24, 1976

[54] SKI BRAKE

[76] Inventor: Hans Wehrli, Zurcherstrasse 81, Rapperswil, Switzerland

[22] Filed: Apr. 24, 1975

[21] Appl. No.: 571,109

Related U.S. Application Data

[63] Continuation-in-part of Ser. No. 460,532, April 12, 1974, Pat. No. 3,884,487.

[30] Foreign Application Priority Data

Feb. 18, 1975 Switzerland ..... 1969/75
Apr. 13, 1973 Switzerland ..... 5387/73

[52] U.S. Cl. ..... 280/11.13 B
[51] Int. Cl.[2] ..... A63C 7/10
[58] Field of Search ..... 280/11.13 B, 11.13 C

[56] References Cited

UNITED STATES PATENTS

| | | | |
|---|---|---|---|
| 3,083,028 | 3/1963 | Miller | 280/11.13 B |
| 3,741,575 | 6/1973 | Bortoli | 280/11.13 B |
| 3,873,108 | 3/1975 | Lacarrau et al. | 280/11.13 B |

*Primary Examiner*—M. Henson Wood, Jr.
*Assistant Examiner*—David M. Mitchell
*Attorney, Agent, or Firm*—Roylance, Abrams, Berdo & Kaul

[57] ABSTRACT

A ski brake includes a length of spring wire of circular cross-section and a holding plate for retaining the brake on the top surface of a ski. The wire has two end portions which are covered with plastic protective caps forming the effective surfaces of the brake. One of the end portions lies on each side of the ski, the brake portions being movable between a position in which they lie essentially in the major plane of the ski and a position in which they extend downwardly below the bottom surface of the ski. A retaining plate is fastened to the top surface of the ski and includes two arcuate recesses which extend transversely across the ski. Between the two end portions, the wire is bent to form a first central shaft portion which extends through one of the arcuate recesses, a second central portion which is U-shaped, and a third central shaft portion which extends through the other arcuate recess. The central portion acts as a spring tending to urge the two end brake portions to their active, downwardly extending position. A small U-shaped bulge permits the central spring portion to clear one of the transverse axis portions to permit the loop to lie flush against the ski surface. Protective caps having longitudinal ribs enclose the end portions to form the active surfaces of the brake.

7 Claims, 3 Drawing Figures

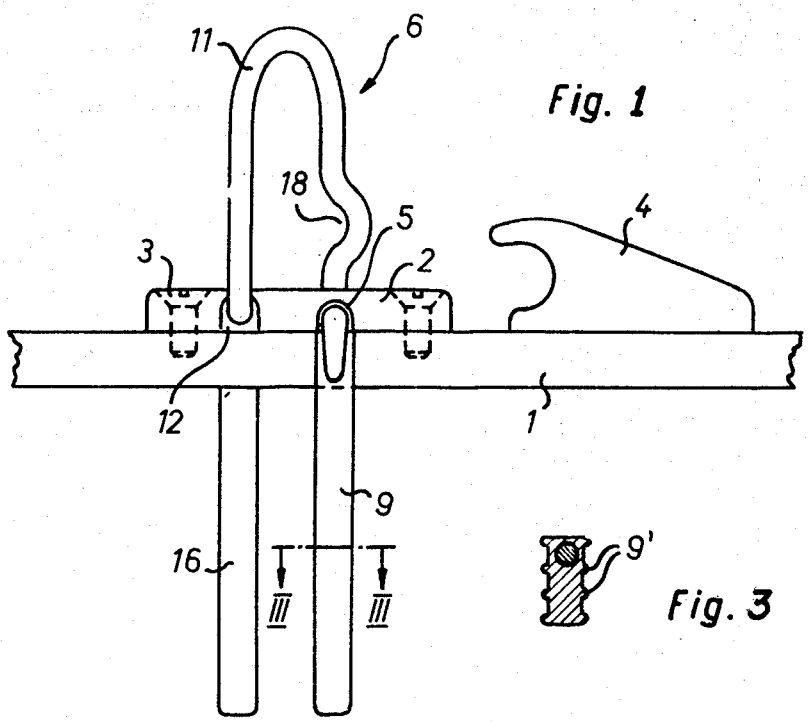
Fig. 1
Fig. 3
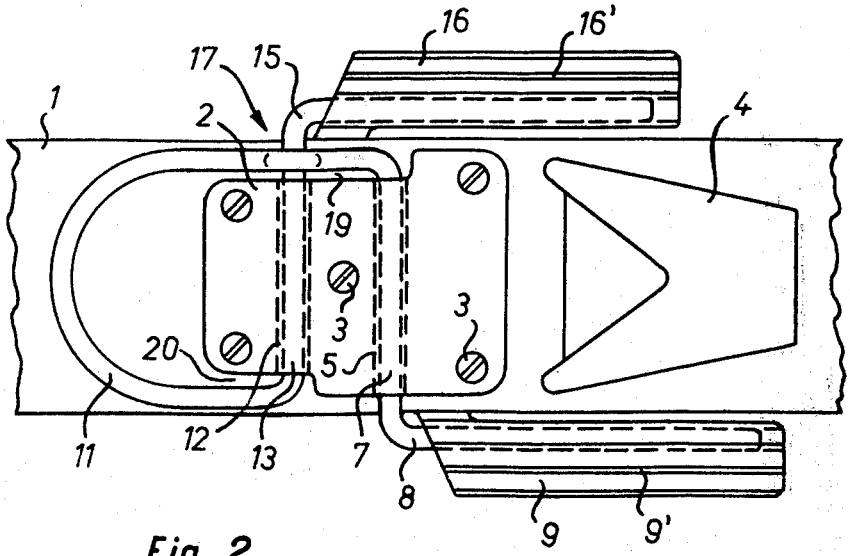
Fig. 2

SKI BRAKE

This application is a continuation-in-part of U.S. patent application Ser. No. 460,532, filed Apr. 12, 1974 and now U.S. Pat. No. 3,884,487.

This invention relates to ski brakes and, particularly, to a spring-urged ski brake structure having brake portions on either side of the ski.

BACKGROUND OF THE INVENTION

This invention relates to a ski brake having brake shoes arranged at the lateral edges of the ski, which brake shoe portions can be swiveled about axes running across the top of the ski. As described in the parent application, ski brakes having spring portions are known but are generally complex and expensive in nature and generally require relatively complicated spring arrangements. Application Ser. No. 460,532 described a structure which is an improvement over the known apparatus and is advantageous, but has the disadvantage of having only one brake shoe so that, in some circumstances, the braking action is not sufficient to brake the ski to a stop within a short distance under conditions of certain kinds of snow and on steep gradients.

An object of the invention is to provide a ski brake of the type described wherein reliable, rapid braking is obtained even under circumstances of hard snow and severe gradients.

Broadly described, the present invention includes a ski brake securable to the upper surface of the ski and having, laterally of the ski, first and second brake spurs which are pivotable about first and second pivot axes which extend transversely across the upper surface of the ski, and a lever depressible by the ski boot to hold the brake spurs in their rest position parallel with the major surface of the ski, the brake spurs being pivotable into their braking positions by spring action upon removal of the ski boot from the ski binding, the improvement in the present invention comprising a wire bent so that one end portion forms a first one of the brake spurs, the other end portion forms the second one of the brake spurs, a first central portion lies in the first one of the pivot axes, a second central portion is shaped into a holding loop forming a holding lever, and a third central shaft portion lies in the second one of the pivot axes, the first and second axes being parallel and longitudinally spaced apart, the holding loop acting as a spring which moves the brake spurs to their braking position and having two positions, one being against the ski when depressed by the ski boot and the other being away from the ski when the ski boot is removed from the binding.

In order that the manner in which the foregoing and other objects can be attained in accordance with the invention can be understood in detail, a specific embodiment thereof will be described with reference to the accompanying drawings, which form a part of this specification, and wherein:

FIG. 1 is a side elevation of a ski brake according to the invention, shown with a fragmentary portion of a ski, in its braking position;

FIG. 2 is a plan view of the ski brake of FIG. 1, shown in its inactive position; and FIG. 3 is a section along lines III—III of FIG. 1.

As shown in FIGS. 1 and 2, a holding plate 2 is fastened by screws 3 onto the upper surface of a ski 1 which is only partially shown in the figures. The holding plate 2 is located in the vicinity of a holding piece 4, which is generally illustrated, which can constitute a heel-holding piece of a safety ski binding. The holding plate includes a recess 5 which comprises a transverse groove extending upwardly into the underside of holding plate 2 so that, when mounted on the ski, a transverse tunnel is provided. A first central shaft portion 7 of a wire rod indicated generally at 6 extends through recess 5 and it is pivotable about a first axis. The rod 6 is bent approximately 90° to form a first end portion 8 which is covered by a brake shoe 9 of plastic material which is firmly attached to the wire rod.

Brake shoe 9 is provided with longitudinal ribs 9′ as shown in FIGS. 2 and 3 which reduce lateral flow of snow off the brake shoe portion and consequently improve the braking action.

At the other end of recess 5 the wire rod is bent 90° in the opposite direction, this constituting a second central portion of the wire rod which forms a U-shaped holding loop 11 which, in the rest position illustrated in FIG. 2, is pressed by a ski boot, not shown, onto the upper surface of the ski. In this position, end portion 8 and brake shoe 9 are pivoted into its rest position which is parallel with the ski and above the running surface thereof.

The other end of loop 11 is bent to form a third central shaft portion 13 which extends through a second recess 12 in holding plate 2. Recess 12 is formed in a fashion similar to recess 5 and it is parallel thereto and longitudinally spaced from recess 5 with respect to the longitudinal axis of the ski. Thus, retaining clip or holding loop 11 is pivoted about both of shafts 7 and 13, these defining first and second pivot axes. It is important that the axes of the two recesses and the two shaft portions which extend therethrough are spaced substantially parallel to each other because wire rod 6 is thereby elastically prestressed.

At the other end of recess 12, and laterally outwardly of the other side of ski 1 the rod is bent 90° to form a second end portion 15 which is covered by and which supports a second brake shoe or spur 16 which, like brake shoe 9, is provided with longitudinal ribs 16′.

It will be recognized that because of the fact that wire rod 6 is elastically prestressed by the paralled staggered positions of the two shaft portions 7 and 13, upon release of the holding loop, brake shoes 9 and 16 are automatically pivoted into their braking positions and held there. Thus, it is important that the wire rod, which serves the dual functions of the mounting of brake shoes 9 and 16 and the formation of a supporting arm in the form of a retaining clip 11, also simultaneously assumes the function of a swivel spring.

Because of the fact that rod 6 is simultaneously a spring, the arrangement of the brake shoes 9 and 16 on the end portions 8 and 15 creates a problem as to the crossing of the wire rod upon itself. It is, of course, important that the satisfactory operation of the brake, despite the limited space available, be assured, particularly without impairing the spring action of rod 6. This is achieved by providing, at the crossing point 17 of rod 6 upon itself in the inoperative or rest position, a small U-shaped indentation or bulge 18 is formed in one side of the major U-shape of holding loop 11. It is important that the bulge 18 is positioned within the depth of holding plate 2, i.e., that the extreme of the bulge in the rest position not extend significantly above the upper surface of plate 2. It will be observed that plate 2 is simultaneously used as the supporting ledge for the ski boot. Thus, the necessary height can be maintained.

Supporting plate 2 appropriately has indentations 19 and 20 on opposite sides of the plate to provide necessary clearance for the straight portions of U-shaped member 11 when the ski brake is in its inoperative position.

While one advantageous embodiment has been chosen to illustrate the invention, it will be understood by those skilled in the art that various changes and modifications can be made therein without departing from the scope of the invention as defined in the appended claims.

What I claim is:

1. In a ski brake securable to the upper surface of a ski and having, laterally of the ski, first and second brake spurs which are pivotable about first and second pivot axes, respectively, extending on the upper side of the ski transversely with respect to the longitudinal axis thereof and a holding lever depressible by the ski boot to hold said brake spurs in a rest position, said brake spurs being pivoted into their braking positions by spring action upon removal of a ski boot from the ski binding, the improvement in the brake comprising a wire bent so that one end portion forms a first one of said brake spurs, the other end portion forms the second one of said brake spurs, a first central shaft portion lies in the first one of said pivot axes, a second central portion is shaped into a holding loop forming said holding lever, and a third central shaft portion lies in the second one of said pivot axes, said first and second axes being paarallel and longitudinally spaced apart, said holding loop acting as a spring which moves said spurs to their braking positions and having two positions, one position being against the ski when depressed by the ski boot and the other position being away from the ski when the ski boot is removed from the binding.

2. A ski brake as claimed in claim 1, and further comprising a holding plate fastenable to the upper side of the ski, and having means defining first and second recesses in which said first central shaft portion and said third central shaft portion are located respectively.

3. A ski brake according to claim 1 and further comprising a protective cap enclosing and protecting each of said brake spurs.

4. A ski brake according to claim 3, wherein each of said protective caps is formed of a plastics material.

5. A ski brake according to claim 4 wherein each of said protective caps is formed with longitudinal ribs.

6. A ski brake as claimed in claim 1, wherein said wire is of circular cross-section throughout its length.

7. A ski brake according to claim 6 wherein said second central portion is substantially U-shaped and is provided with a smaller U-shaped bent portion in a plane approximately perpendicular to the major plane in which the second central portion lies.

* * * * *